United States Patent [19]

Guscott

[11] Patent Number: 4,888,581

[45] Date of Patent: Dec. 19, 1989

[54] PRESSURE SENSITIVE SECURITY SYSTEM FOR TRACKING MOTION OVER A SURFACE

[75] Inventor: John K. Guscott, Stow, Mass.

[73] Assignee: Aritech Corporation, Framingham, Mass.

[21] Appl. No.: 178,190

[22] Filed: Apr. 6, 1988

[51] Int. Cl.[4] ..... G08B 13/10

[52] U.S. Cl. ..... 340/666; 200/85 R; 200/86 R; 200/61.93; 340/565

[58] Field of Search ..... 340/666, 565; 200/61.93, 85 R, 86 R

[56] References Cited

U.S. PATENT DOCUMENTS

| | | | |
|---|---|---|---|
| Re. 32,180 | 6/1986 | Lewiner et al. | 340/666 |
| 2,683,784 | 7/1954 | Rector | 340/666 |
| 3,346,866 | 10/1967 | Bechtel | 340/666 |
| 4,075,616 | 2/1978 | Rait | 340/666 |
| 4,347,505 | 8/1982 | Anderson | 340/666 |

*Primary Examiner*—Glen R. Swann, III

*Attorney, Agent, or Firm*—Weingarten, Schurgin, Gagnebin & Hayes

[57] ABSTRACT

An alarm system uses an area sensor having a piezoelectric film sensitive to changes in pressure. A piezoelectric film with electrodes deposited on opposite surfaces of the film converts changes in mechanical pressure to electrical signals. A signal processor detects the electrical signals and generates an output signal in response. The electrodes could comprise single metalized sheets deposited on each surface. Alternatively, an array or pattern of individually operative electrodes could be provided. An array or pattern of electrodes enables the signal processor to determine the location, motion, and direction of motion of a force generating pressure changes on the piezoelectric film. The alarm system may include a threshold detector sensitive to the magnitude of pressure changes so that an output signal will not be generated unless the pressure change is sufficiently great. This invention is suitable as a floor covering for detecting an intruder walking over its surface.

7 Claims, 5 Drawing Sheets

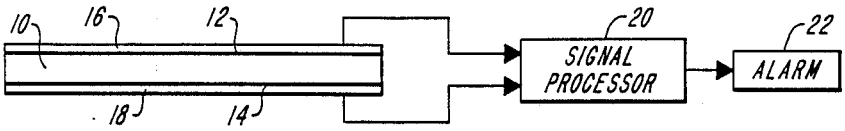
FIG. 1
FIG. 2
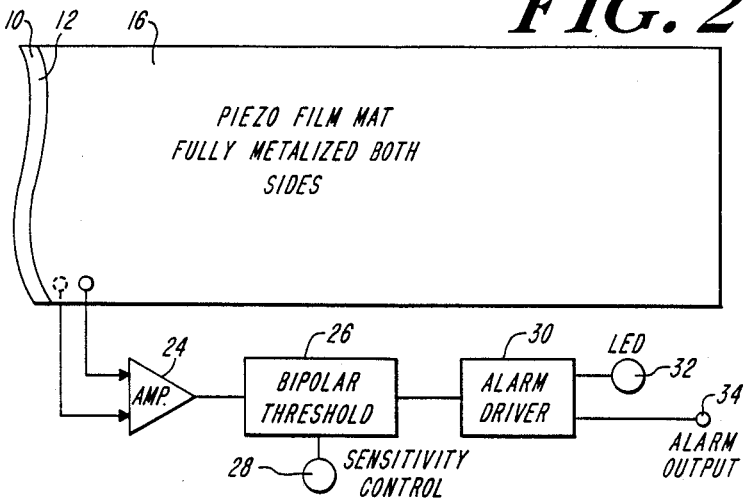
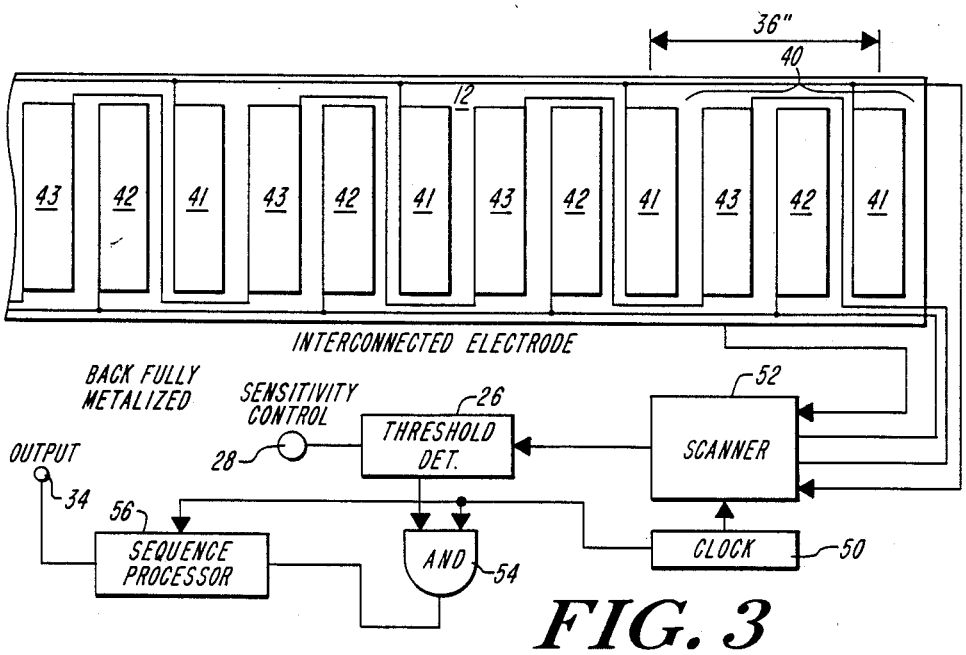
FIG. 3

PRESSURE SENSITIVE SECURITY SYSTEM FOR TRACKING MOTION OVER A SURFACE

FIELD OF THE INVENTION

This invention relates generally to security systems and more particularly to area sensitive security systems.

BACKGROUND OF THE INVENTION

Security systems are known which are sensitive to the presence of an intruder within a protected space. Different types of sensors are usually employed in a given security installation. Entrances and exits and windows are typically protected by security switches which are activated upon the opening of the associated door or window. Vibration sensors are often employed on glass panes to detect tampering and breakage of the glass. Motion within a protected space is usually sensed by infrared, ultrasonic or electromagnetic motion sensors which provide an output signal in the presence of a detected intruder. The sensors are usually wired or otherwise coupled to a central alarm control which, in turn, is coupled to alarm annunciators and which may be coupled to automatic telephone dialers for calling a predetermined number in the presense of intruder detection.

Mat switches are known for the protection of entrance ways and hallways. These mat switches are, for example, sensitive to the applied pressure of an intruder to cause switch activation and alarm signaling. These mat switches are in the form of a thin mat which typically is installed under a carpet and includes one or more switch contacts activated by a person stepping onto the mat.

A major problem in the design of a security system is to minimize false alarms. Much of the improvement in security systems over the years has been in the improved capability of such systems to discriminate between true intrusion and noise and spurious events which could cause a false alarm.

Present motion sensors are generally operative to detect the presence of a moving intruder, but are not able to track the motion of the intruder within the protected space or to discriminate between intruder size. Thus present motion sensors are triggered by dogs and cats as well as people and cannot be employed if pets are allowed to roam within a protected area. A problem with present mat switches is that furniture placed over the mat can activate the switch contacts, triggering a continuous alarm signal.

SUMMARY OF THE INVENTION

The present invention provides a security system having area sensitivity to intrusion, effectively zero false alarm susceptibility, and the ability to discriminate between people and smaller animals entering the protected space. The novel system employs a thin piezoelectric film having appropriate electrode patterns thereon disposed on the floor of a protected area and operative to provide electrical signals in response to the pressure of an intruder on the film surface. The film is typically disposed beneath or within a carpet or other mat layer covering the protected area of a floor. The film electrodes are connected to a signal processor operative to provide an output indication of intruder presence. The signal processor can be responsive to the pressure on the piezoelectric film above a predetermined threshold to thereby remain immune to lesser pressures as would be caused by dogs and cats moving about the protected surface. Only in the presence of the pressure above the threshold level caused by a human intruder would an output alarm indication be provided. The motion of a detected intruder within the area of the sensitive film can be tracked by the signal processor and output indications of intruder motion can also be provided.

In the simplest case the pressure sensor comprises a piezoelectric film having a conductive electrode on each surface. Pressure applied to the sensor causes a voltage to appear across the electrodes which can be processed by the signal processor to provide an output indication of intruder presence. Alternatively, the piezoelectric film can have a plurality of cooperative electrodes on the respective surfaces to provide respective output signals depending on the location of the intruder on the protected surface. In yet another embodiment, a pattern of electrodes can be provided on one or both of the film surfaces and which are cooperative with the associated signal processor to detect the presense of an intruder and the motion of the intruder across the film surface.

The ability of the film sensor to track motion on its surface allows a degree of intelligence which is especially attractive for many alarm installations. With knowledge of the location and motion of a intruder force on the piezoelectric film, the system can determine if a person entered an area via a legitimate entry point or whether entry was via an illegal entry point. The system can also determine whether an object materialized apparently from nowhere as would be caused by an object falling from a table or shelf onto the protected surface.

The piezoelectric sensor can be manufactured in any convenient size and can be of a configuration to be cut to suit particular protected areas during installation. Thus irregular areas or corridors can be protected, and all or parts of a room or other facility can be protected as desired. The sensor can be placed beneath a rug or other floor covering, or can be manufactured with a wear-resistant coating bonded or otherwise attached. Once installed, the sensor is not obvious to an intruder and is especially suited to use in homes and offices or other locations where appearance is important.

DESCRIPTION OF THE DRAWINGS

The invention will be more fully understood from the following detailed description, read in conjunction with the accompanying drawings in which:

FIG. 1 shows a block diagram of the present invention;

FIG. 2 shows an embodiment of the invention of FIG. 1;

FIG. 3 shows a further embodiment of the present invention;

DETAILED DESCRIPTION OF THE INVENTION

Figure 4:
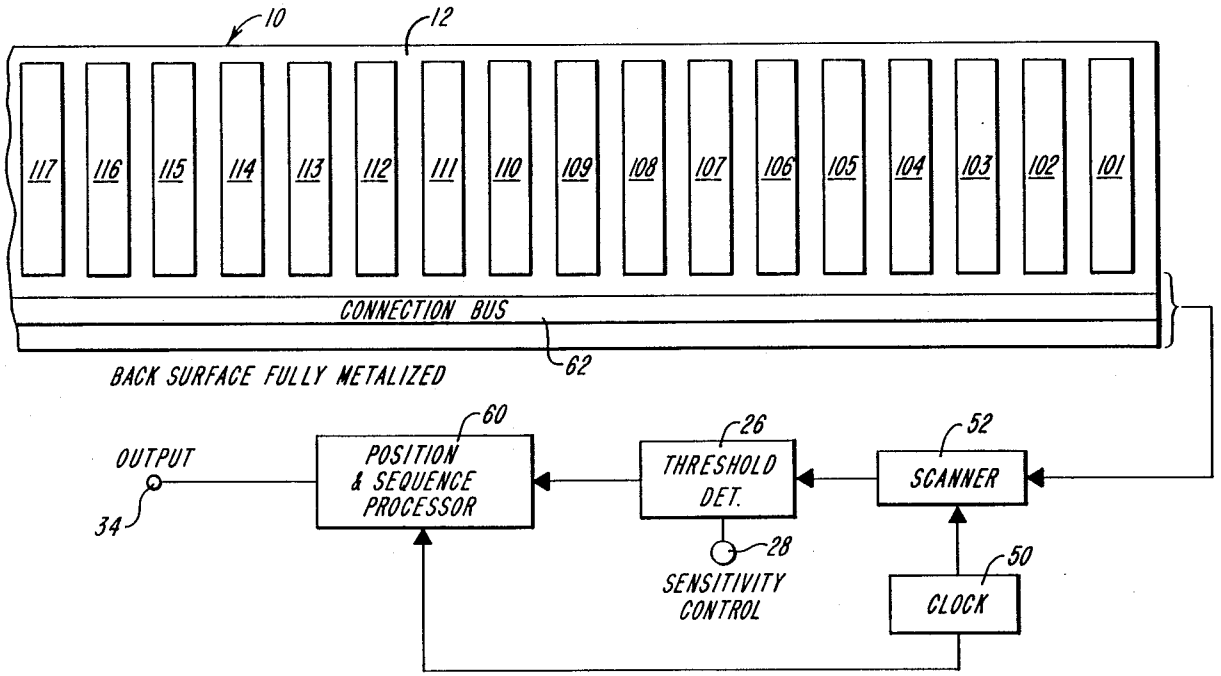
FIG. 4 shows a third embodiment of the present invention.

FIG. 1 shows the security system of the present invention. An area sensor comprises a piezoelectric film 10 having a first electrode 16 on first surface 12 of the piezoelectric film and a second electrode 18 on a second surface 14 of the film. A signal processor 20 is connected to the electrodes to receive electrical signals generated by the piezoelectric film 10. The signal processor 20 is connected to an alarm or operator monitor 22.

In operation, an object or intruder pressing on the piezoelectric film 10 causes the film 10 to deform, the deformation of the piezoelectric material generating a voltage between the electrodes 16 and 18. The signal processor analyzes the signal from the film 10 and in response generates an output signal which is directed to alarm 22, which generates an alarm signal or other output indication.

FIG. 2 shows an embodiment of the present invention, showing the piezoelectric film 10 in plan view. Each electrode 16 and 18 comprises a metal layer covering the respective surfaces 12 and 14 of the piezoelectric film 10. Each electrode 16, 18 could alternatively comprise conductive ink printed on the piezoelectric film 10. The processor 20 includes an amplifier 24 and a bipolar threshold detector 26. The magnitude of the voltage generated will depend on the magnitude and rate of change of the pressure applied. Threshold detector 26 can be set so that only forces equal to or greater than a predetermined minimum force will trip the alarm. For example, the threshold detector can be set at 65 pounds, the weight of a small human. Suitable frequency and bandwidth considerations in the processor can differentiate high force, small area disturbances that might be produced by a pet. A sensitivity control 28 on the threshold detector 26 enables an operator to set the threshold detector for any suitable threshold force.

An alarm driver 30 causes an output signal to be generated. The output signal can cause a light emitting diode 32 or other indicator to turn on, alerting an operator. The alarm driver can also include an alarm output 34 which can be employed to sound an alarm and/or trigger an automatic telephone dialing for call an emergency number.

FIG. 3 shows an embodiment of the present invention including a more complex electrode array on the first surface 12 of the piezoelectric film 10. The electrodes on surface 12 comprise a repeating pattern 40 of three interconnected electrodes 41, 42 and 43. The electrodes 41 of each pattern 40 are connected to each other. Similarly all electrodes 42 are connected to each other and all electrodes 43 are connected to each other. The pattern 40 is spaced wider than a normal human footprint. Thus, an intruder walking on the film 10 would be sure to step on each electrode 41, 42, and 43. The electrode 18 on the opposite surface 14 is a single sheet as shown in FIG. 1. An electronic scanner 52 is connected to the electrodes and is operative to identify which electrodes 41, 42, or 43 are activated. The output of the scanner 52 is connected to threshold detector 26.

A clock 50 drives scanner 52, enabling detection of the times when electrodes 41, 42, or 43 become operative. An output from the threshold detector 26 indicates that an object of sufficient force has moved onto the piezoelectric film. The output of the threshold detector 26 is clocked through an AND gate 54 to a sequence processor 56. The time sequence of electrical signals coming from the electrodes 41, 42 and 43 is determined by processor 56, to ascertain whether the object on the film 10 is moving.

To deduce direction of motion or to pinpoint location, a larger number of electrodes per pattern can be used. FIG. 4 shows an embodiment suitable for a hallway or main walkway of a room. The first surface 12 of the film 10 is covered with a series of independently operative electrodes 101 through 117. As many electrodes as desired can be included. The electrodes in FIG. 4 are connected to the scanner 52 via a connection bus 62. The signal processor in this embodiment includes a position and sequence processor 60 operative to determine position and direction of motion of an intruder and to provide an output signal representative thereof.

Figure 5:
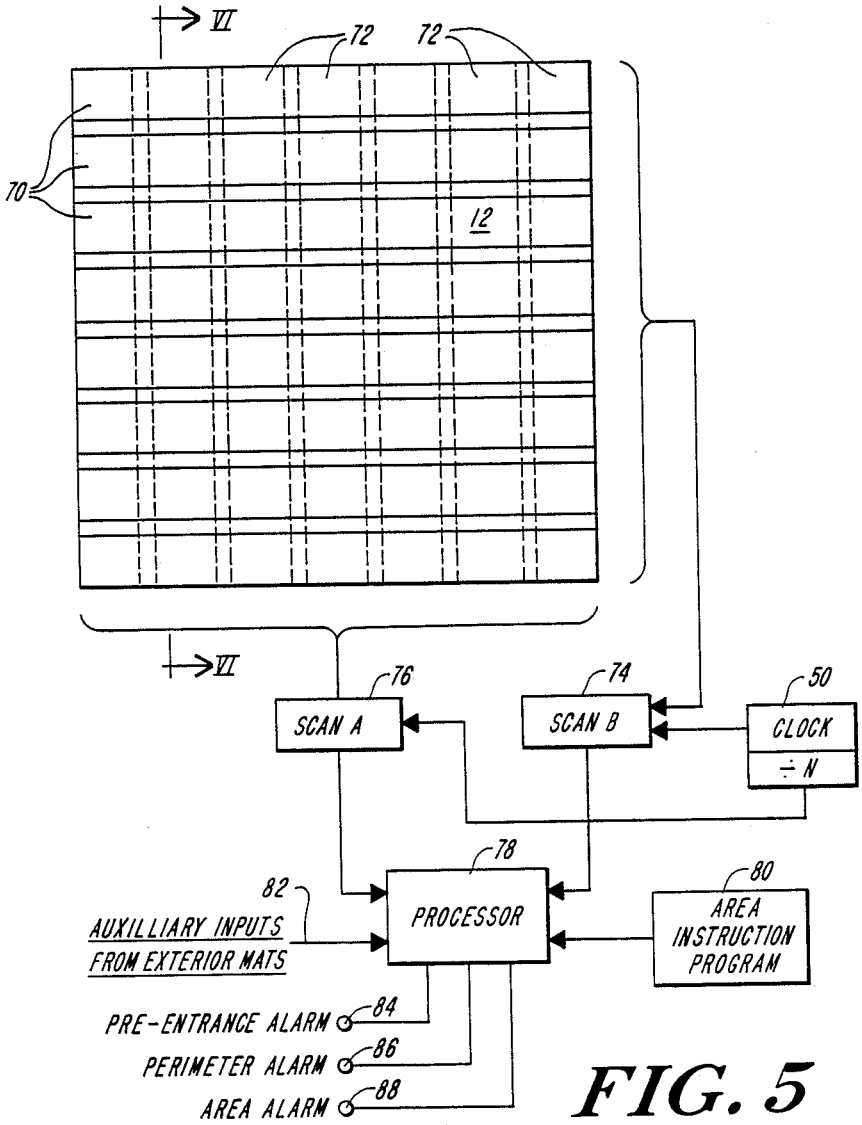
FIG. 5 shows a fourth embodiment of the present invention.
Figure 6:
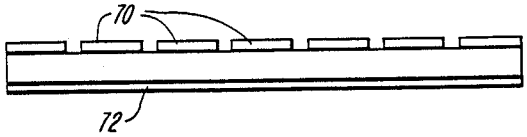
FIG. 6 shows a cross-section along line VI—VI of the embodiment of FIG. 5.

A more sophisticated electrode arrangement is shown in FIG. 5. The first surface 12 of the piezoelectric film 10 includes an electrode comprising a series of parallel independently operative strip electrodes 70. The opposite surface 14 of the piezoelectric film 10 includes electrodes comprising a series of parallel independently operative strip electrodes 72 placed normal to the strip electrodes on the opposite face. This results in a large number of squares each identified by the intersection of a strip electrode 70 and a strip electrode 72. The signal processor includes a scanner 74 for the electrode strips 70 on surface 12 and a scanner 76 for the electrode strips 72 on the other surface 14. Clock 50 drives both scanners 70 and 72. The output from both scanners are sent to a sequence and position processor 78. By determining the intersection of the operative strip electrode on one surface and operative strip electrode on the other surface, the position of an object on the piezoelectric film can be determined. Motion and direction of motion of the object can be determined from the time sequence. The geometry of the protected area can be programmed into the signal processor via area instruction program 80. Thus, irregular areas can be covered and an object can be located at any point in that area.

The security system of the present invention can be divided into independently operable segments of piezoelectric film. For example, the perimeter of the piezoelectric film can remain operable while the center or main area of the piezoelectric film is disabled. This feature is useful when the occupants are at home, so that they may move freely around the center of the premises. FIG. 5 shows a separate alarm output 86 for the perimeter and an alarm output 88 for the central area.

Other piezoelectric film sensors can be placed in other areas of the building to be protected and can send their electrical signal to a single signal processor. Thus, the piezoelectric film sensor can be placed outside the building adjacent to entrances, on or underneath window sills, on thresholds of doors, or anywhere protection is desirable. FIG. 5 shows an additional input 82 and an additional output 84 for additional piezoelectric film sensors. The signal processor can generate an alarm signal indicating an object in any of these particular areas. This system can replace a variety of sensors used in a conventional security system. A conventional system consists of a number of different sensors including door contacts, window sensors, and volumetric sensors. Signals from a piezoelectric film sensor just inside a doorway would replace the door contact by indicating that someone had crossed the threshold. This could be further improved by the addition of an outside mat.

Similar piezoelectric film sensors placed on or under windows would replace window sensors. The volumetric sensors of conventional systems could be replaced by the general piezoelectric film sensors covering a large area itself. Many security systems have the ability to operate in two modes usually called home and away. In the home mode the volumetric sensors are ignored to allow the occupants to freely move around the premises. The piezoelectric film sensor can operate in this fashion by having independent alarm outputs for the perimeter and for the main area. The extension of the system outside the building allows users to know when an intruder is trying to gain entry rather than notifying the user after an intruder has already entered.

Figure 7:
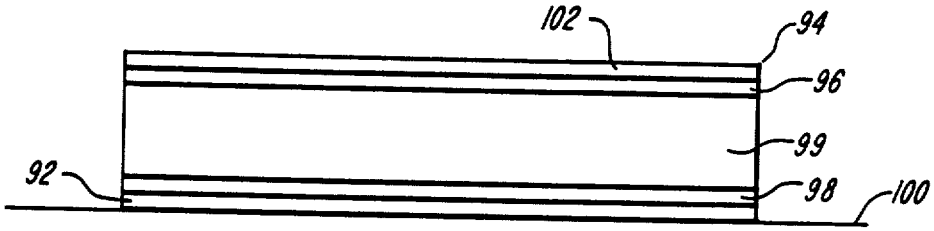
FIG. 7 shows an area sensor of the present invention having an underlayer and an overlayer.

As shown in FIG. 7, a plastic foam layer 92 may underlay the area sensor 94, having electrodes 96, 98 and piezoelectric film 99 resting on floor 100. A rubber layer 102 may overlay the area sensor 94.

Other applications of the invention and other embodiments are contemplated.

I claim:

1. An alarm system comprising:

an area sensor comprising a piezoelectric film having first and second surfaces and electrode means on the first and second surfaces, the piezoelectric film being operative to convert a change in mechanical pressure on the piezoelectric film to an electrical signal on the electrode means, the electrode means on the first surface of the piezoelectric film comprising an array of independently operative electrodes, the array arranged in a pattern which repeats at least once, each electrode in the array being operatively connected to a corresponding electrode in the repeated array;

signal processing means including means for detecting the electrical signal generated by the area sensor and further including means for generating an output signal responsive to the electrical signal detected by the detecting means; and alarm means responsive to the output signal to generate an alarm signal.

2. The alarm system of claim 1 wherein the electrical signal detecting means includes a threshold selection means for preselecting a threshold value for the electrical signals corresponding to a preselected minimum pressure change; and the output signal generating means is responsive to the preselected threshold value to generate an output signal when the pressure changes reach the preselected minimum pressure change.

3. The alarm system of claim 1 including a plastic foam layer underlaying the area sensor.

4. The alarm system of claim 1 including a rubber layer overlaying the area sensor.

5. The alarm system of claim 1 wherein the electrode means comprises conductive ink printed on the piezoelectric film.

6. An alarm system comprising:

an area sensor comprising a piezoelectric film having first and second surfaces, a first array of independently operative electrodes arranged in parallel strips on the first surface, and a second array of independently operative electrodes arranged in parallel strips normal to the electrode strips of the first array on the second surface, the piezoelectric film being operative to convert a change in mechanical pressure on the piezoelectric film to an electrical signal on the electrodes;

means for processing the signal generated by the area sensor including means for detecting the signal and means for generating an output signal responsive to the signal detected by the detecting means; and means responsive to the output signal to generate an alarm signal.

7. The alarm system of claim 6, wherein the signal detecting means includes a threshold selection means for preselecting a threshold value for the signals corresponding to a preselected minimum pressure change; and the output signal generating means is responsive to the preselected threshold value to generate an output signal when the pressure changes reach the preselected minimum pressure change.

* * * * *

UNITED STATES PATENT AND TRADEMARK OFFICE

CERTIFICATE OF CORRECTION

PATENT NO. : 4,888,581

DATED : December 19, 1989

INVENTOR(S) : John K. Guscott

It is certified that error appears in the above-identified patent and that said Letters Patent is hereby corrected as shown below: ON TITLE PAGE:

5 Drawings Sheets should read 4 Drawing Sheets

In the Drawings:

Please add attached Figure 7 to the drawings.

In Column 1, line 25, "presense" should read --presence--.

In Column 2, line 24, "presense" should read --presence--.

In Column 3, line 45, "for call" should read --to call--.

In Column 4, lines 55-56, "window sills" should read --windowsills--.

Signed and Sealed this

Twenty-third Day of June, 1992

*Attest:*

DOUGLAS B. COMER

*Attesting Officer*

*Acting Commissioner of Patents and Trademarks*